US007033280B2

(12) United States Patent
Hottle et al.

(10) Patent No.: US 7,033,280 B2
(45) Date of Patent: Apr. 25, 2006

(54) GOLF FLAGSTICK FERRULE AND METHOD OF USE

(75) Inventors: Scott M. Hottle, Waterloo, IA (US); Steven R. Tyler, Waverly, IA (US)

(73) Assignee: Standard Golf Company, Cedar Falls, IA (US)

( * ) Notice: Subject to any disclaimer, the term of this patent is extended or adjusted under 35 U.S.C. 154(b) by 0 days.

(21) Appl. No.: 10/870,836

(22) Filed: Jun. 17, 2004

(65) Prior Publication Data

US 2005/0282649 A1 Dec. 22, 2005

(51) Int. Cl.
*A63B 57/00* (2006.01)

(52) U.S. Cl. ..... 473/176

(58) Field of Classification Search ..... 473/175–179
See application file for complete search history.

(56) References Cited

U.S. PATENT DOCUMENTS 1,329,732 A * 2/1920 Verity ..... 473/176
3,180,644 A * 4/1965 Winquist ..... 473/177
3,348,797 A * 10/1967 Turbyfill ..... 248/539
4,114,879 A * 9/1978 Oiler ..... 473/177
4,360,200 A * 11/1982 English ..... 473/177
4,878,665 A * 11/1989 Boudreau et al. ..... 473/175
5,393,053 A * 2/1995 Wiese et al. ..... 473/177
5,451,045 A 9/1995 Garske
5,964,667 A 10/1999 Brookman
6,113,503 A 9/2000 Brookman
6,722,997 B1 * 4/2004 Gilmour ..... 473/176
2002/0198059 A1 * 12/2002 Gilmour ..... 473/176
2003/0096659 A1 * 5/2003 Webb ..... 473/174

OTHER PUBLICATIONS

Tacit catalog page, "What makes Tacit's Flagstick and Hole cup "System" the best in the world", published on or before Jan., 2003.

* cited by examiner

*Primary Examiner*—Mark S. Graham
(74) *Attorney, Agent, or Firm*—McKee, Voorhees & Sease, P.L.C.

(57) ABSTRACT

A ferrule that includes a ledge having an underside with indentations. The indentations cooperating with a golf putting cup that has a ferrule socket formed by a plurality of primary fins. The ferrule and ferrule socket cooperating to prevent spinning of the flag, resist wear, and provide a straight standing flagstick.

10 Claims, 6 Drawing Sheets

GOLF FLAGSTICK FERRULE AND METHOD OF USE

BACKGROUND OF THE INVENTION

The present invention relates generally to the field of golf course accessories, and more particularly, to an improved golf flagstick ferrule.

Golf flagsticks used on golf courses experience a variety of difficulties including sticking inside the golf putting cup, wearing from use, a tendency of the flagstick to "walk" out of the cup in windy conditions, and maintaining a straight standing flagstick in a golf putting cup even as the cup and ferrule experience wear.

One approach to the problem is disclosed in U.S. Pat. No. 5,451,045 issued Sep. 19, 1995. The '045 patent discloses a drainage ferrule having a plurality of valleys or grooves about its outer circumferal surface, allowing water, sand or other debris to pass through the socket while the ferrule is in the socket. This drainage ferrule does not act, however, to prevent the accumulation of sand and other debris in the ferrule socket. In addition, the '045 patent has a shortcoming in that the drainage ferrule is grooved and wears faster than an ungrooved ferrule causing excessive wear especially during a rotating motion caused by wind or player action.

Accordingly, a primary objective of the present invention is the provision of an improved golf flagstick ferrule and method of use.

Another objective of the present invention is to lock the ferrule into the golf putting cup in order to prevent the flagstick from turning once the flagstick is inserted into the cup.

Another objective of the present invention is to provide a self-centering, positive detent when the flagstick is inserted into the cup. The positive detent provides the player with feedback that the flagstick is fully inserted into the cup and assures the flagstick is standing straight. In the prior art, the ferrule when inserted into the cup, simply rested loosely on the cup bottom but because the player does not feel a positive detent the flagstick may not be fully inserted into the cup here and consequently the flagstick may not be standing straight. This condition can be further problematic if the user inserts the flagstick at an angle, if there is debris in the ferrule or cup service, or if the ferrule and ferrule socket is worn.

A further objective of the present invention is the provision of a ferrule that is self-centering. A self-centering ferrule does not require the player to match the ferrule with members of the golf putting cup on placing the flagstick in the cup nor does the player have to insert the flagstick at a precise angle when placing it into the putting cup. A self-centering cup permits the player to merely get the ferrule started to have it drop with a positive detent into the cup.

Another objective of the present invention is to create a more precise fit between the ferrule and cup so that the flagstick stands straight in the cup.

Another objective of the present invention is the provision of a golf flagstick assembly that minimizes debris adhering and precipitates any debris upon the ferrule or within the golf putting cup.

A further objective of the present invention is the provision of a ferrule and golf putting cup that maintains vertical alignment even during surface wear.

Another objective of the present invention is the provision of a golf putting cup that allows the ferrule of a flagstick to be easily inserted and removed.

A still further objective of the present invention is an improved method for using a flagstick and a golf putting cup.

Another objective of the present invention is the provision of a golf putting cup that is efficient in operation, economical to manufacture, and durable in use.

These and other features, objectives and advantages will become apparent to those skilled in the art with reference to the accompanying specification.

SUMMARY OF THE INVENTION

The foregoing objectives may be achieved with a golf flagstick assembly that includes a golf flagstick, a golf putting cup with a ferrule socket made of cooperating primary fins, and a ferrule fitting within the socket. The ferrule has an upper portion and a lower portion, the upper portion having a ledge wider than the lower portion and a plurality of indentations upon the underside of the ledge. The ferrule indentations fitting upon the top surface of fins to provide non-sticking properties, resistance to wear, less tendency to the flagstick to "walk" out of the cup in windy conditions, and a straighter standing flagstick even as the cup ferrule experiences wear.

The foregoing objectives may also be achieved by a golf flagstick ferrule that has a head portion having a ledge extending beyond an outer circumference of a base portion. The ledge having at least one indentation upon an underside to engage the golf putting cup.

A further feature of the present invention is the ferrule locking within the putting cup to prevent the flagstick from turning after inserted into the putting cup. In windy conditions, the fluttering motion of the flag transmitted through the flagstick causes the flagstick to oscillate, which in turn causes the flagstick to rotate in the cup. This rotation causes excessive wear on both the ferrule and cup, and can additionally cause a flagstick to "walk" out of the ferrule socket of the cup. The ferrule of the present invention prevents the flagstick from turning in causing excessive wear or alleviates "walking" out of the ferrule socket.

A further feature of the present invention is the provision of a self-centering, positive detent when the flagstick is inserted into the cup. This is in contrast to conventional putting cups which are constructed with a low angle bottom that slopes toward the center of the cup and conventional ferrule heads constructed at a reciprocal angle.

A further feature of the present invention is a large head portion or upper portion of a ferrule with indentations on the underside of a ledge of the head portion that engages fins of a ferrule socket.

A still further feature of the present invention is the indentations being radiused so that the flagstick is "self-centering". The radius feature does not require the player to match the indentations of the ledge of the ferrule to the fins of the putting cup when placing the flagstick into the putting cup. In addition, this feature does not require the player to insert the flagstick at a precise angle when placing it into the putting cup. This feature enables the player to merely get the ferrule started and the flagstick will drop into the putting cup.

Another feature of the present invention is a more precise fit between the ferrule and the cup so that the flagstick stands straight in the cup. The indentations on the underside of the ferrule head and the fins of the putting cup are designed in a complete golf flagstick assembly so that they precisely interact to allow for a close tolerance and maximum vertical support. This feature enables the ferrule to be locked onto the surface of the fins and therefore not move from side to side as a result of wind or player action.

Another feature of the present invention is to engage only a small portion of the top surface of the fins that make up the ferrule socket with a limited surface area of the ferrule as defined by the indentations. This permits debris adhered to the surface of either the ferrule or the fins to be rapidly dissipated when the ferrule engages the fins since there is no closed ferrule socket or cup bottom surface to hold the debris. Moreover, this feature is enhanced by the fact that the ferrule, once inserted into the cup, cannot rotate and therefore no additional debris falling into the cup can work its way between the ferrule and the ferrule socket of the cup.

Another feature of the present invention is a precise fit between the ferrule and the putting cup that holds the flagstick in a straight vertical position even as the ferrule and cup wear through corresponding tapered surfaces. Even as these surfaces begin to wear, the fit between the ferrule and the surface of the fins is maintained as the ferrule comes to rest at a lower point in the cup since the downward taper will offset the wear.

The foregoing objectives may also be achieved using a method of a flagstick with a golf putting cup to prevent the flagstick from spinning within the socket. The method comprising the steps inserting a ferrule that has a cylindrical lower portion and an upper portion with a plurality of indentations into a ferrule socket defined by a plurality of circumferentially spaced apart inner edge of primary fins in the putting cup. The method also including the step of interconnecting the plurality of indentations with a plurality of top surface of primary fins in the putting cup to prevent axial rotation of the flagstick and center the flagstick within the putting cup.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalents which may be included within the spirit and scope of the invention.

Figure 1:
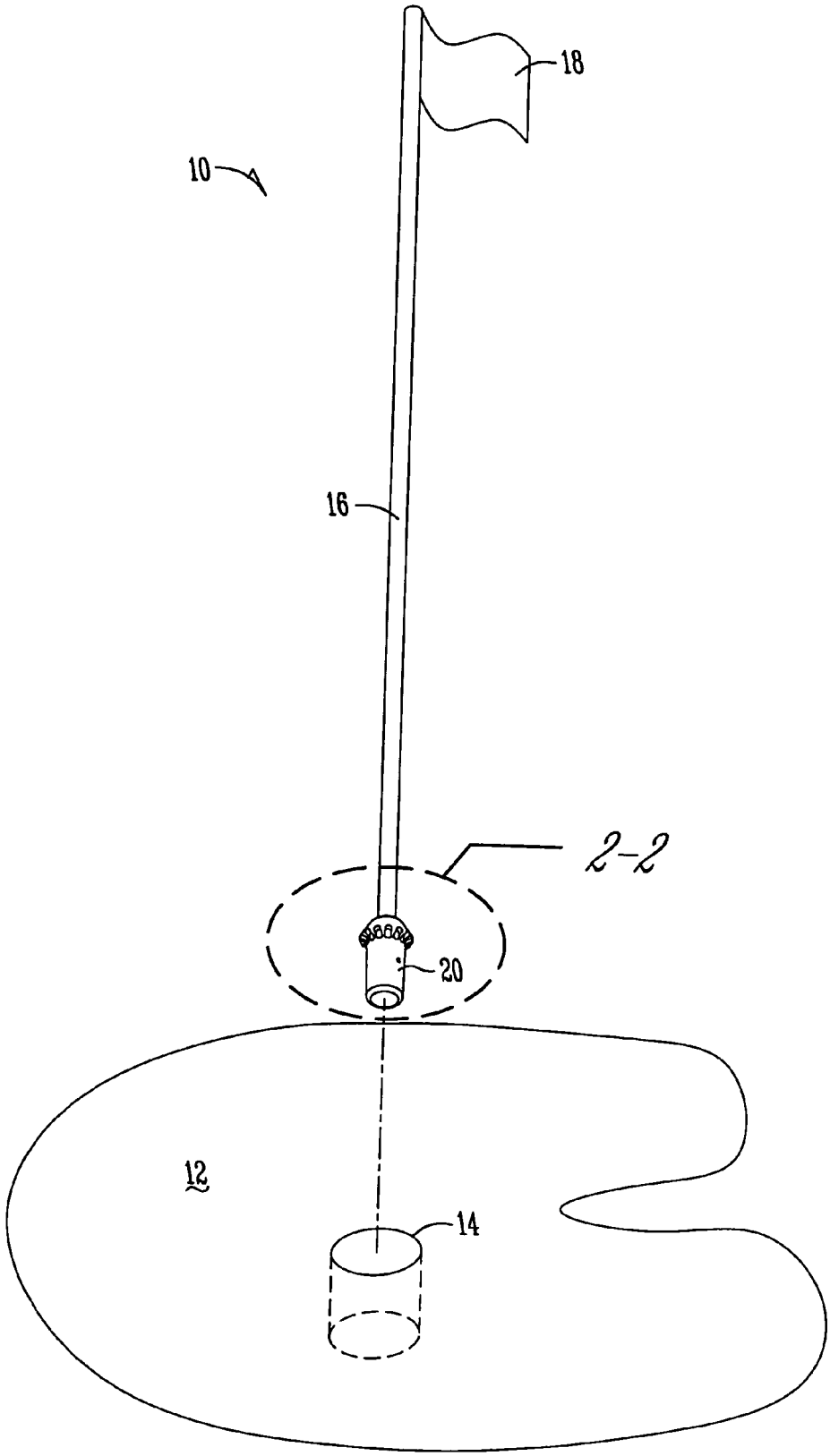
FIG. 1 is a perspective view of a golf flagstick assembly utilizing a ferrule of the present invention.

FIG. 1 shows the golf flagstick assembly 10 of the present invention. The golf flagstick assembly 10 is shown in use on a putting green 12 that has a golf putting cup 14 located upon it.

Figure 2:
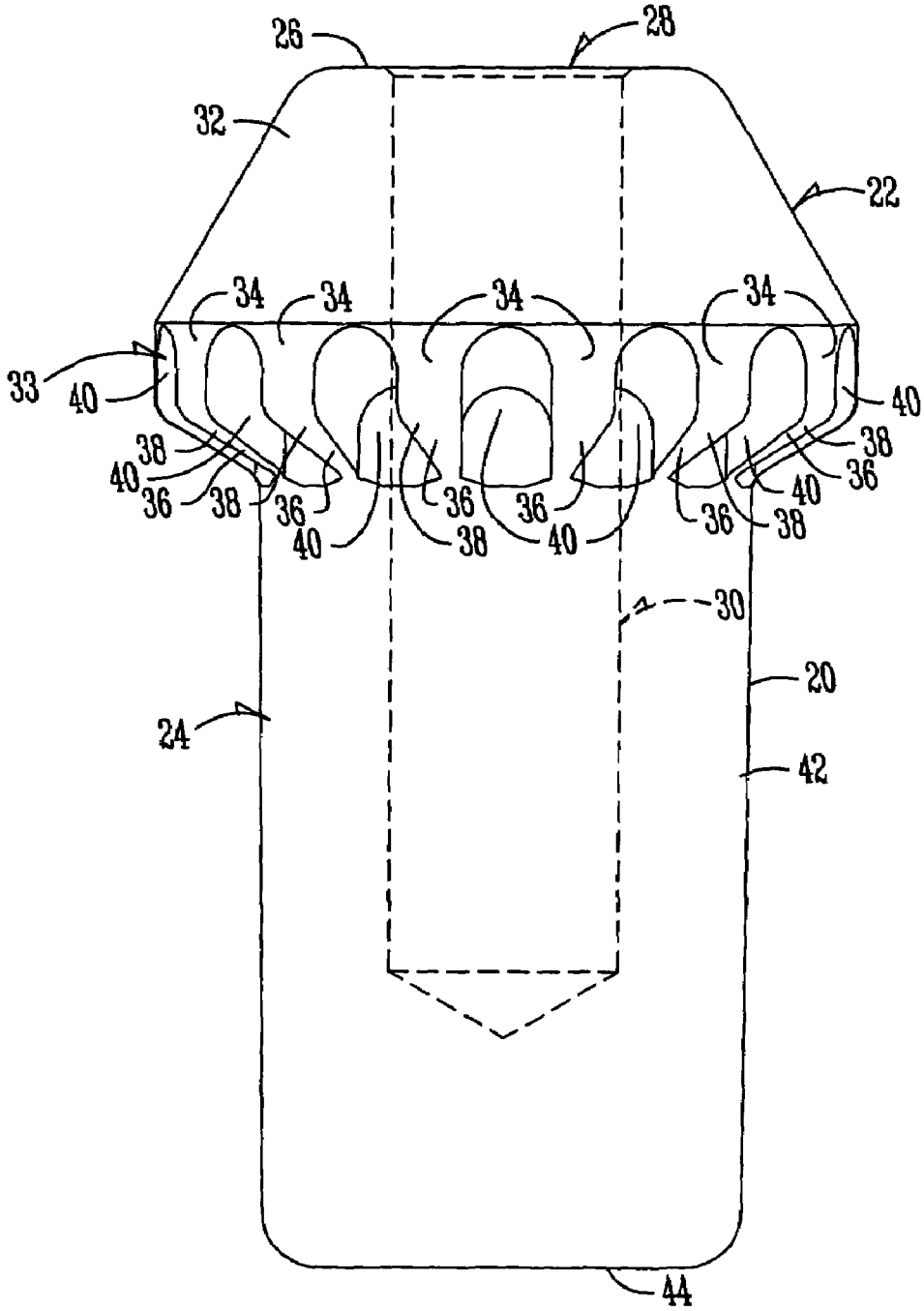
FIG. 2 is a side view of the ferrule of the present invention.

A side view of the ferrule 20 of the present invention is shown in FIG. 2. The ferrule 20 has a head portion or upper portion 22 and a body portion or lower portion 24. The ferrule 20 has a top end 26 having a center opening 28 that leads to a chamber 30 in which the flagstick is placed. The upper portion 22 has a conical section 32. The conical section 32 tapers away from the top end 26 to a ledge 33. A ledge 33, as illustrated, has an annular base 34 and a lower taper 36. Indentations or grooves 40 are formed in the underside of the ledge 33. Two indentations generally define a fin 38.

The ferrule 20 also has a cylindrical portion 42. There are no indentations along the cylindrical portion 42 that align with the indentations 40. The ferrule 20 ends at bottom end 44. It is preferred that the ferrule 20 is cast from aluminum or die cast from zinc. Alternatively, the ferrule may be made of hardened plastic or other material.

Figure 3:
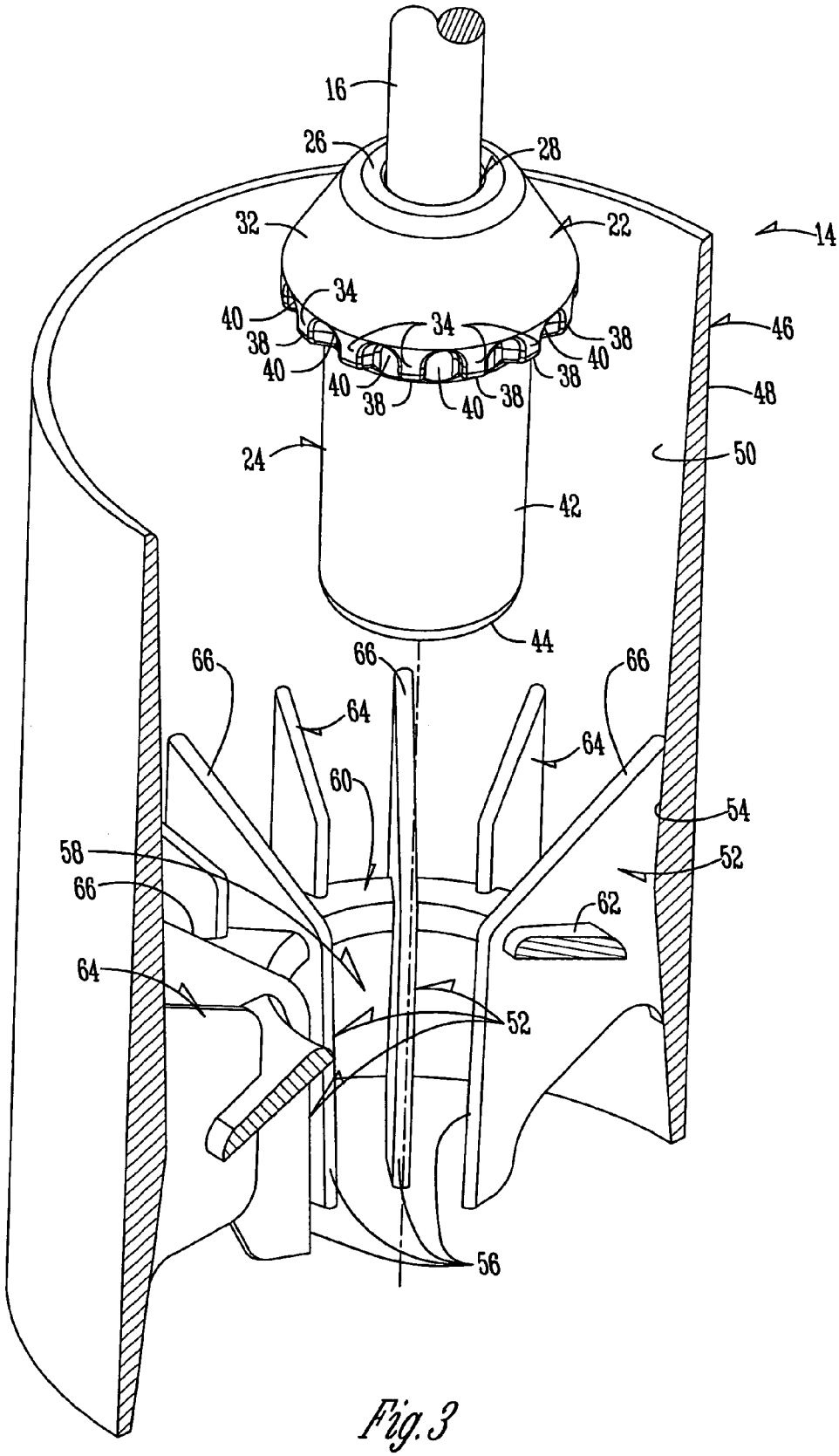
FIG. 3 is a perspective view of the ferrule in position over a socket of a golf putting cup.

FIG. 3 shows the golf flagstick ferrule 20 of the present invention in position over a golf putting cup 14.

The putting cup 14 has an outer cylindrical wall 46. The outer cylindrical wall includes an outer surface 48 and an inner surface 50.

The putting cup 14 has a bottom portion that includes a plurality of primary fins 52 that are spaced apart adjacent the inner surface 50 of the outer cylindrical wall 46. The primary fins 52 are maintained in a generally vertical direction and extend between a first end 54 at or proximate the inner surface 50 of the outer cylindrical wall 46 toward the center of the cup to a second end 56. It is the second ends 56 of the primary fins 52 that form the ferrule socket 58. Because the second ends 56 of the primary fins 52 are spaced apart, the structure defining the ferrule socket 58 has a small surface area. As a result, there is less surface area for sand and other debris to accumulate and become trapped between the ferrule 20 and the ferrule socket 58.

The primary fins 52 are tied together for strength by a substantially horizontal band 60. Unlike the bottom of a traditional putting cup, however, this band 60 has a top surface 26 that slants downwardly and away from the ferrule socket 58. Therefore, any sand or other debris falling onto the band 60 is directed towards the outside of the cup and will fall through a space between the band 60 and the inner surface 50 of the outer cylindrical wall 46.

A plurality of secondary fins 64 are also provided which provide reinforcement for the bottom portion of the cup and also prevent the ferrule 20 from accidentally becoming jammed between the primary fins 52. The primary fins 52 are rounded at their top edges 66 to prevent the accumulation of debris.

It is preferred that all components of the putting cup 14 of the present invention be made from a hardened plastic material. Alternatively, the putting cup 14 may be cast from aluminum or die cast from zinc.

The present invention solves the problems associated with sand and other debris by essentially eliminating any surfaces within the cup in which debris can accumulate. In operation, any sand falling on the band 60 is directed away from the ferrule socket 58 and towards the outside of the putting cup. Thus, large amounts of sand and other debris do not accumulate in the ferrule socket 58. Further, when the ferrule 20 is inserted into the ferrule socket 58, there is not a large surface area for the sand to become trapped between the second ends 56 of the primary fins 52 and the indentations 40 of ferrule 20. As such, the ferrule 20 may be easily inserted and removed without sticking against the walls of the ferrule socket 58.

Figure 4:
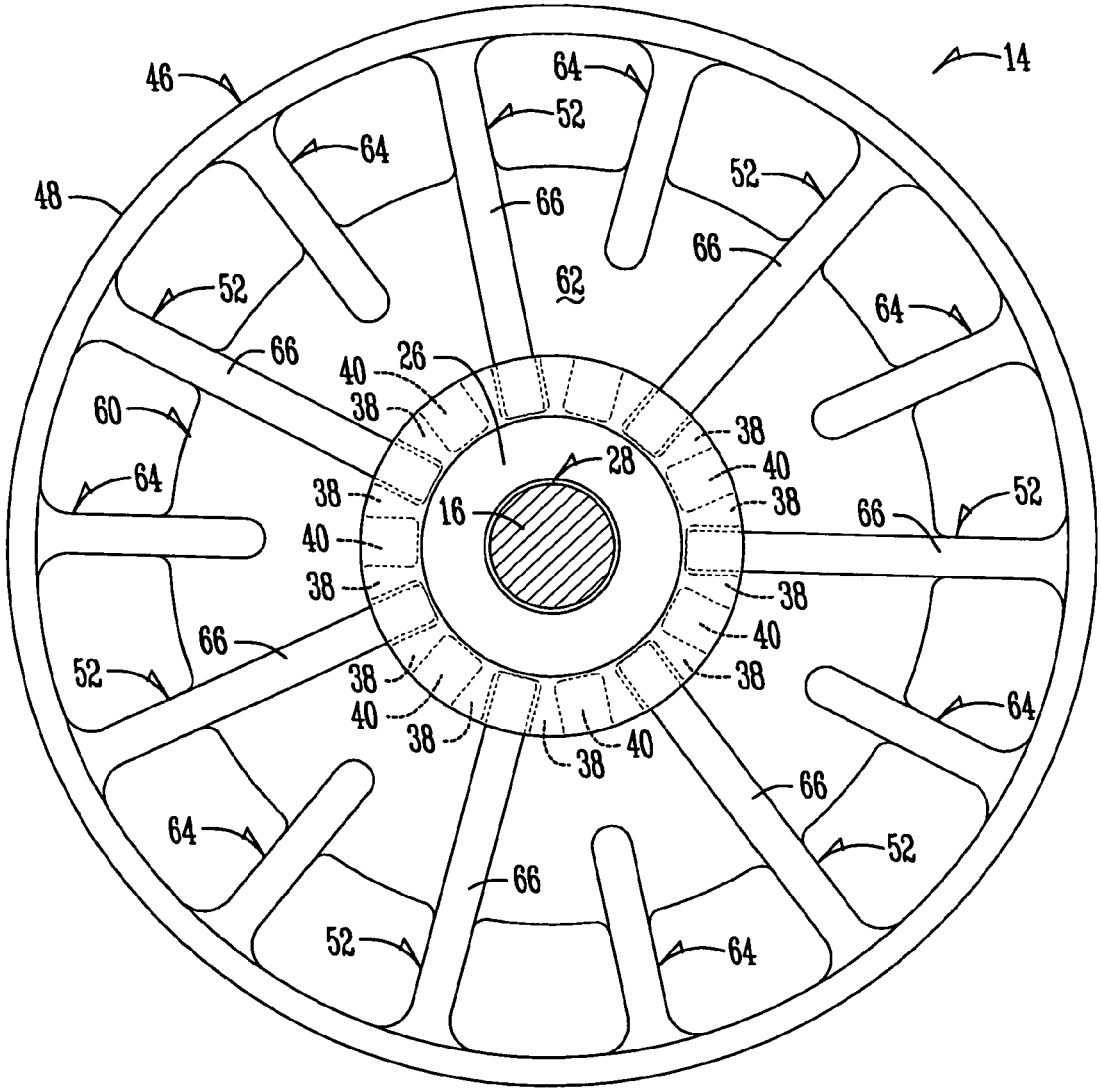
FIG. 4 is a top elevational view of the ferrule in position upon a golf putting cup.

As seen in FIG. 4, the ferrule indentations precisely align with the top surface 66 of primary fins 52. As shown, there are seven primary fins 52 and fourteen indentations 40. The putting cup and ferrule have been designed together to provide a precise fit to maintain the flagstick 16 in a straight upright manner.

Figure 5:
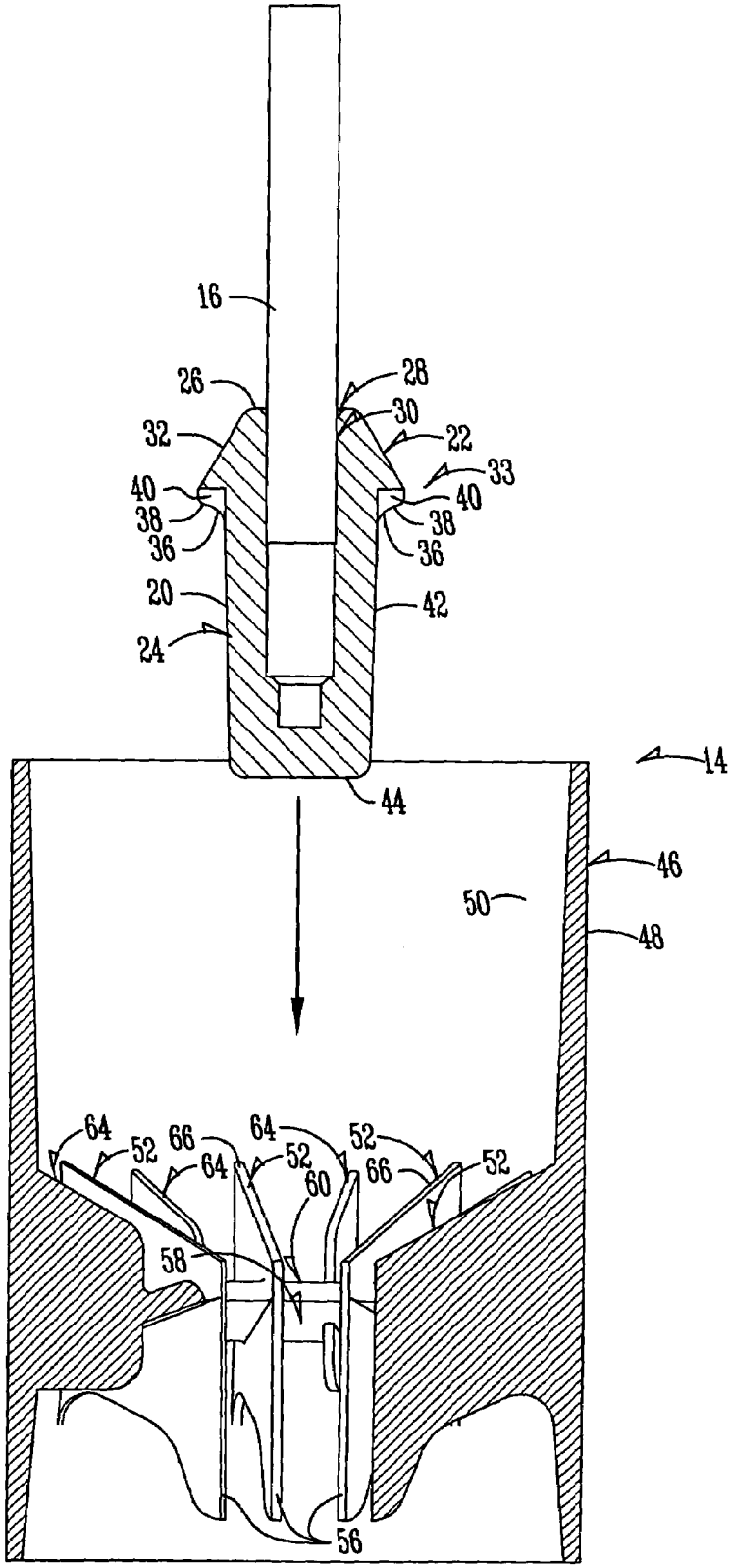
FIG. 5 is a side cross-sectional view of the ferrule in alignment over a golf putting cup.
Figure 6:
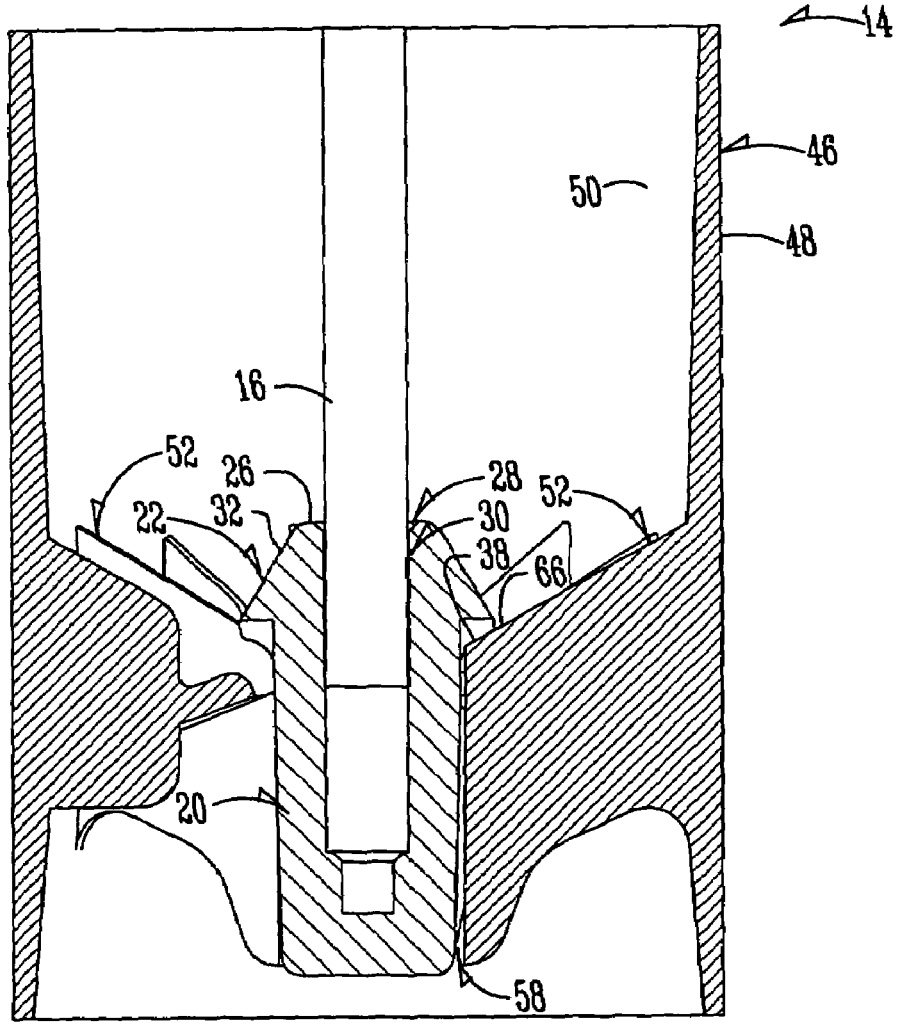
FIG. 6 is a side cross-sectional view of the ferrule in position upon a golf putting cup.

In use, as seen in FIGS. 5 and 6, the ferrule is positioned over the golf putting cup. Although depicted in axial alignment in FIG. 5, the ferrule 20 may be positioned in at an angle to the ferrule socket 58. The ferrule is then placed into the socket where it provides a positive detent to the user as the ferrule 20 enters the ferrule socket 58. The indentations 40 of the ledge 33 fit over the top edge 66 of the fins 38 and the ferrule fins 38 of the ferrule fit between the primary fins 52 of the putting cup 14.

From the foregoing, it can be seen that the present invention accomplishes at least all of its stated objectives.

What is claimed is:

1. A golf flagstick assembly with non-spin properties, the assembly comprising:

a golf flagstick having a ferrule at one end;

a golf putting cup with an outer cylindrical wall having an inner surface, a plurality of primary fins extending inward from a first end proximate the inner surface to a second end, the second ends of the fins being spaced apart from one another and defining a ferrule socket;

the ferrule having an upper portion and a lower portion, the upper portion having a ledge wider than the lower portion, a plurality of indentations upon an underside of the ledge;

the ferrule moveable between a first position above the golf putting cup and a second position wherein the lower portion rests within, and engages only the primary fins of the ferrule socket and the indentations matingly engage a top surface of the fins.

2. The golf flagstick assembly of claim 1 wherein the golf putting cup primary fins are arranged within the outer wall so that the second ends of the fins are disposed in a generally vertical direction and spaced apart circumferentially for engaging the ferrule lower portion.

3. The golf flagstick assembly of claim 1 wherein the indentations on the ledge are spaced apart circumferentially for engaging the fins.

4. The golf flagstick assembly of claim 1 wherein the lower portion is cylindrical.

5. The golf flagstick assembly of claim 4 wherein the lower portion is without indentations.

6. The golf flagstick assembly of claim 1 wherein the indentations are radiused to permit passive centering of the indentations upon the top surface of the fins.

7. The golf flagstick assembly of claim 1 wherein the ferrule moves from the first position to the second position with a positive detent.

8. The golf flagstick assembly of claim 1 wherein the ferrule indentations and the top surface of the fins correspondingly taper downward.

9. The golf flagstick assembly of claim 1 wherein the plurality of indentations are more numerous than the plurality of primary fins.

10. A method for using a golf flagstick having a non-spin ferrule with a golf putting cup; the ferrule having an upper portion and a lower portion, the upper portion having a ledge wider than the lower portion so that the ledge includes an underside, a plurality of indentations being on the underside of the ledge; the putting cup having and outer cylindrical wall surrounding a longitudinal axis; a plurality of primary fins being connected the outer cylindrical wall and extending inward in a radial direction with respect to the longitudinal axis of the cup to terminate in spaced apart inner edges defining a ferrule socket; the primary fins each having a top surface; the method comprising:

inserting the lower portion of ferrule into the ferrule socket so that the lower portion engages only the inner edges of the fins;

inserting the top surfaces of the fins into the indentations to prevent rotation of the flagstick with respect to the putting cup.

* * * * *